US006478010B2

(12) United States Patent
Kiessling

(10) Patent No.: US 6,478,010 B2
(45) Date of Patent: Nov. 12, 2002

(54) IGNITION MODULE WITH ROTATIONAL SPEED LIMITATION FOR AN INTERNAL COMBUSTION ENGINE

(75) Inventor: Leo Kiessling, Cadolzburg (DE)

(73) Assignee: Prüfrex-Elektro-Apparatebau Inh Helga Müller, geb. Dutschke, Cadolzburg (DE)

( * ) Notice: Subject to any disclaimer, the term of this patent is extended or adjusted under 35 U.S.C. 154(b) by 0 days.

(21) Appl. No.: 09/908,002

(22) Filed: Jul. 16, 2001

(65) Prior Publication Data

US 2002/0117148 A1 Aug. 29, 2002

(30) Foreign Application Priority Data

Jul. 20, 2000 (DE) ..... 100 35 657
Nov. 21, 2000 (DE) ..... 100 57 870

(51) Int. Cl.[7] ..... F02P 9/00
(52) U.S. Cl. ..... 123/335; 123/406.53; 123/406.66
(58) Field of Search ..... 123/335, 406.53, 123/406.66, 334, 319, 406.59, 406.11

(56) References Cited

U.S. PATENT DOCUMENTS 3,738,340 A * 6/1973 Olson ..... 123/335
4,111,174 A * 9/1978 Fitzner et al. ..... 123/339.11
4,133,325 A * 1/1979 West ..... 123/406.53
5,526,785 A * 6/1996 Masters ..... 123/198 DC

* cited by examiner

*Primary Examiner*—Bibhu Mohanty
(74) *Attorney, Agent, or Firm*—Frank H. Foster; Kremblas, Foster, Phillips & Pollick

(57) ABSTRACT

A revolution threshold regulator and/or toggle switch has a first and a second fixed phase source of alternating current having a frequency proportional to the revolution speed of a rotor of an internal combustion engine. A trigger device scans the alternating currents to emit a control signal at a revolution threshold above or below a preset revolution threshold. The trigger device has a timer module which cooperates with one of the alternating current sources through a trigger charge element which can be discharged via at least one discharge path to create a control signal. The trigger charge element, as it discharges, sends a control current through a series Zener diode in a blocking direction to the control signal output.

18 Claims, 11 Drawing Sheets

Fig. 3 SIGNALS

Figure 1:
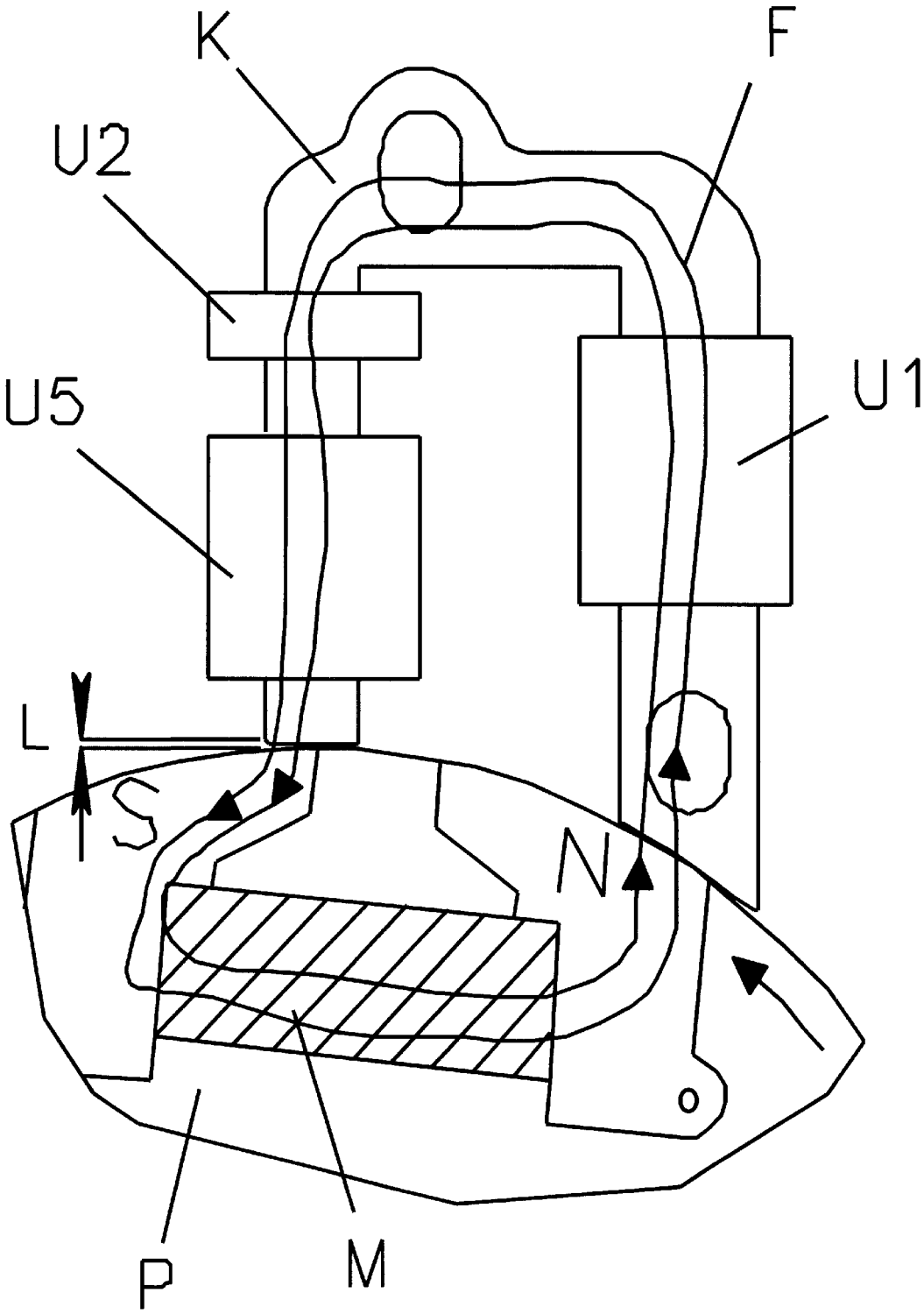

A
243 µs CORRESPONDS TO ±2.43% FOR tp = 5ms
B
78 µs CORRESPONDS TO ±1.63% FOR tp = 5ms
Ig
1.600uA
1.400uA
1.200uA
1.000uA
0.800uA
0.600uA
0.400uA
0.200uA
0.000uA
t
3.800ms
3.900ms
4.000ms
4.100ms
4.200ms
4.300ms
4.400ms
4.500ms
4.600ms
4.700ms
4.800ms
4.900ms
5.000ms

IGNITION MODULE WITH ROTATIONAL SPEED LIMITATION FOR AN INTERNAL COMBUSTION ENGINE

(e) BACKGROUND OF THE INVENTION

1. Field of the Invention

The invention refers to an arrangement for starting a motor, especially in hand-held machines using a magnetic generator which induces alternating current dependent on the revolutions and thus charges an ignition charger element for ignition spark energy which serves the accumulation and provision of energy to generate an ignition spark. Moreover, the arrangements cover a trigger which scans the alternating current which is designed to activate an ignition circuit which is discharged with the primary coil of an ignition transfer interacting with an ignition charger element. The trigger has a circuit or other module to limit the revolution speed of the motor and this revolution limiter module works with a trigger charger element which is charged from a source of alternating current from the magnetic generator which can be discharged by at least one path for activating the ignition circuit. Further more, the invention refers to a revolution threshold regulator or toggle switch for same.

2. Description of the Related Art

As is known, an ignition spark is generated using an ignition module with which one revolution of the crankshaft of a machine is initiated. Hand-held tools with motors or combustion engines are already used, whose ignition is connected with a revolution governor in order to prevent too many revolutions as a result of failure or incorrect use. Too many revolutions can endanger the motor and the user. In order to limit the revolution speed of the motor, no ignition sparks are produced by the ignition device or ignition module above a preset revolution. The preset revolution upper limit is only slightly above the working revolution speed. This requires a precise revolution working limit with a narrow tolerance so that the ignition does not stop during normal operation.

However, current ignition modules with revolution limiters are relatively expensive. The accuracy of the revolution limits depends, on the one hand, on the accuracy of the parts used and their tolerances and, on the other hand, on the control and electricity supply of the energy for the revolution limiter circuit. This energy comes from the ignition spark generation. This problem has already been approached in patent publication WO 96/23 971 and U.S. Pat. No. 4,538,586. A substantial role in triggering the ignition process and thus also for the revolution limiter is the so-called ignition thyristor which ensures that the charged ignition capacitor connected to the ignition transformer or transfer is suddenly discharged. The ignition thyristor is not only used to trigger the ignition process but also to prevent the ignition trigger processes in order to limit the number of revolutions. This is managed by the energy for the ignition capacitor, which is induced by a charge coil, and is short circuited by the ignition thyristor so that the ignition capacitor is not charged.

We further refer to the current state of the technology in DE 196 45 466 A1, DE-AS 19 54 874, EP 0 584 618 A2 and U.S. Pat. No. 4,449,497.

DE-AS 19 54 874 has an ignition device for a motor where a switch with anode-cathode paths can be controlled in the conductive state when a maximum revolution speed is exceeded. In order to guarantee a defined switch through of the anode-cathode paths when the maximum admissible revolution is exceeded, the named publication suggests connecting a Zener diode to the control electrode of the ignition thyristor, whose anode is connected to the control cathode and whose cathode is connected to a monitoring capacitor. The effect of the Zener diode with the trigger capacitor, which provides energy for controlling the ignition thyristor, however, is not mentioned.

DE 196 45 466 A1 includes an ignition circuit for a motor with trigger coil and trigger capacitor which is charged therefrom. The control connection of an ignition thyristor to discharge the ignition capacitor charged from one of the ignition coils is controlled via a potentiometer-type resistor together with the charging of the trigger capacitor. In order to guarantee a precise and constant number of revolutions despite the longer duration of the ignition spark, connecting a Zener diode in blocking direction to earth in parallel to the trigger capacitor is planned whose Zener voltage drops out at the potentiometer-type resistor. As a result, the capacitor voltage is limited to the voltage of the Zener diode to approximately 120 Volts. The trigger capacitor, the Zener diode and the potentiometer-type resistor are connected in parallel in the known ignition circuit. The decisive factor in the situation of the maximum admissible revolution is the ON period activated by the trigger capacitor at the control input of the ignition thyristor. Its end is determined by the size of the trigger capacitor and the resistances of the potentiometer-type resistors, as well as by the sensitivity of the control input of the ignition thyristor and the amplitude of the alternating current which charges the trigger capacitor. The use of a sole parallel Zener diode in accordance with the known suggestion does not produce a sufficient avoidance of time fluctuations in the revolution limit. For example, with the ignition thyristor, the input lines which set the sensitivity differ from version to version. In the revolutions limiter circuit according to the design, the gate control current typically fluctuates between, for example, 200 nA and 1 $\mu$A. A control threshold voltage of, for example, 700 mV can fluctuate by ±150 mV, which in turn affects the current sensitivity in the circuit of the control input of the ignition thyristor. The sensitivity of the ignition thyristor is defined by the gate control current at which the thyristor switches through. The control threshold voltage does not change the sensitivity of the thyristor (based on its control current) but it does influence the gate control current in the circuit. In order to keep these effects as small as possible, the resistances of the potentiometer-type resistors are optimised according to the known suggestions and operate the revolution limitation with a relatively high control energy. Generally, typical values for the trigger capacitor are 220 nF, with the charge voltage being between 100 and 150V. In the discussed publication DE 196 45 466 A1, the charge voltage of the trigger capacitor is given as 120V.

The invention is based on the task of reducing the tolerances and inaccuracies in limiting the revolutions which are caused by the parts used in the revolutions limiting module and also the control energy required for the ignition circuit. In particular, the dynamics of the revolution-limiting module should be increased considerably if the working point is within the deviating control area of the ignition circuit.

As a solution, it is proposed, for the arrangement with the features discussed at the start, that a series Zener diode, which is operated in the blocking direction, be connected to the ignition circuit or its control input from the trigger charger element when it discharges a control current. The proposal differs from the statement in the patent publication mentioned above, DE 196 45 466 A1, because the control input of the ignition thyristor, according to the latter, is activated by a trigger capacitor via a potentiometer-type resistor—without the serial circuit for a Zener diode.

To increase the accuracy of the revolutions limiter further and, in particular, to compensate for unavoidable fluctuations in the available series Zener diodes, especially within their Zener breakdown voltages, after developing the invention, it is planned that a similar parallel Zener diode in the blocking direction be connected against the trigger charger element such that the charge voltage from the trigger charger element, especially for the trigger capacitor, is limited to the sum of the Zener breakdown voltages of the two Zener diodes. Preferably, the two Zener diodes will come from the same manufacturer so that they have the same electrical characteristics and control characteristics. As a result, their fluctuations can compensate each other. The Zener breakdown voltages for the two Zener diodes in the invention so designed that when the maximum admissible revolution is reached or the revolution limiter module is activated, both Zener diodes conduct at times while the trigger charger element is charging.

Based on the introduction of the series Zener diodes in the invention, the ignition circuit can be activated without further ado if, for the appropriate revolution, the alternating current conducted to the trigger charger element is so high that at least the series Zener diode can be transferred into breakdown. In order to increase the ignition reliability of the motor when starting, the development of the invention allowed for the revolution limiter module with the series Zener diodes to bridge a parallel current path from the alternating current to the control input of the ignition circuit. In other words, a further current path is planned from a resistance of the trigger source to the control input of the ignition circuit. The size of the parts of this current path determines the revolution with which ignition device on the motor switches on. The control impulses with limited duration from this current path to the control input of the ignition circuit are also useful as control impulses from the revolution limiter module. Thus the ignition circuit always receives a control impulse first from the named, bridged current path and then determines the ignition point of the ignition arrangement. With the appropriate development of the invention, this causes the bridging parallel current path to be realised with the resistance which, compared to the revolution limiter module formed with the charger, causes practically no dead time or run delay from the alternating current or trigger source.

Preferably, the ignition circuit is realised with a thyristor by which the control current at the control input required for switch through falls corresponding to the increasing voltage and increasing acceleration of this voltage at the anode-cathode paths. This can have negative effects for revolution just below the maximum admissible because it his area, the voltage at the ignition charger element or capacitor, which is connected to the switch path of the thyristor ignition circuit, increases particularly steeply. At the same time, the current at the control input of the thyristor has not yet returned to zero and can even be just below the threshold required for switch through. Because of the lowered threshold for the gate control current required for switch through of the thyristor ignition circuit, this ignition circuit can switch through unnecessarily during the charge phase of the ignition charger element. To prevent this, the invention is designed such that activation of the thyristor ignition circuit is stopped by the revolution limiter module using an additional block switch. This starts shortly after the start of the ignition charger charge phase until its end. To do this, a threshold switch can be used, for example, which switches through above a specific threshold for a control voltage. An advantageous development has the switch on threshold of the block switch designed such that the discharge of the ignition charger element or capacitor with the stated charge or voltage value above the ignition transfer does not cause a spark transfer to the spark gap.

As part of the general invention, there is also an independent use of the revolution limiter module on the invention as a revolution threshold regulator and/or toggle switch for universal use in connection with setting the revolution.

Further more, the general idea covers the following:

Arrangement to start a motor, especially in hand-held tools, with a magnetic generator (P;N;S) which induces alternating current based on the revolution and thus charges an ignition charger element (U4) for ignition energy, and with a trigger (U2, U10) which scans the alternating current (I, II, III) to activate an ignition circuit (U9) that is discharged via the primary coil of an ignition transfer (U5), where a revolution-related function is activated by a revolution circuit, which is designed such that the revolution circuit which works by comparing 2 fixed events with the time of an electronic circuit controlled by the RC timer, where the timer is started by a first fixed event (voltage pulse) and the switch state of the revolution circuit when the second event occurs is determined by the time of the second event (voltage pulse) relative to the controlling end of the timer, where the start of the control with the first fixed event and the end of the control with the charge amplitude being undercut by approximately 50% from C of the RC timer.

As a result, the ignition module has an application where the affected electrical circuit emits an impulse at the start of the second fixed voltage impulse when a certain revolution speed is exceeded. This circuit can be used in an ignition module where the ignition thyristor is controlled by the second fixed signal above a specific revolution speed. This signal still comes before the signal which controls the thyristor to discharge the ignition capacitor. This provides the function that carries out a jump "early" when a certain revolution is exceeded. The advantage of the circuit with the two Zener diodes also has an effect when the electrical circuit is a transistor, for example, since the amplification of a transistor also fluctuates in the same way as the thyristor gate trigger current and the threshold voltage on the control path of the transistor fluctuates comparably.

The invention is generally usable for revolution metering and not only for revolution limiting.

Example: adjustable jump:

Revolution metering by comparing two fixed events with the time of a timer corresponding to the invention, i.e. from the discharge curve of an RC unit, the flat part, preferably 50%, is divided by a series Zener diode ZDs so that only the steep part leads to the activation of an electronic circuit as above, where the series Zener diode ZDs together with a ZDp connected in this range determines the charge voltage of the capacitor of the RC unit.

(f) BRIEF SUMMARY OF THE INVENTION

Arrangements about how to start a motor, in particular, in hand-held machines, especially with a revolution threshold regulator and/or toggle switch with a magnetic generator which induces alternating current dependent on the revolutions and thus charges an ignition charger element for ignition spark energy, and with a trigger which scans the alternating current in order to activate a discharged ignition circuit in the ignition element in conjunction with the primary coil of an ignition transfer in the ignition charger element, with the trigger being a module for limiting the revolution speed of the motor and this revolution limiter working with a trigger charger element which can be recharged from a source of alternating current in the magnetic generator, which can be discharged by at least one path for controlling and activating the ignition circuit, where the trigger charger element, as it discharges, sends a control current to an ignition circuit via a series Zener diode in blocking direction and revolution threshold regulator and/or toggle switch, with an initial source of alternating current and a second source with fixed phase, which are both generated and which depend on and in their frequency in proportion to the revolution of a mutual rotor, and with a trigger which scans the alternating current in order to issue a control signal above or below the preset revolution threshold, where the trigger has a timer module, in particular RC-timer or monoflop, and this timer module works with a trigger which is charged from a source of alternating current which can be discharged by at least one path to create the control signal, where the trigger charger element, as it discharges, sends a control current to an ignition circuit via a series Zener diode in block direction.

(g) BRIEF DESCRIPTION OF THE SEVERAL VIEWS OF THE DRAWINGS

FIG. 1. A schematic representation of a magnetic generator with ignition, trigger and ignition transfer coils, FIG. 2. An arrangement principle already known with revolution limitation in block circuit diagram corresponding to the patent publication EP 0 854 618 A2 named above, FIG. 3. Voltage and current time diagrams for individual function blocks from FIG. 1, presented in relation to each other by time, FIG. 4. A voltage/time diagram for the gate control input of the thyristor ignition circuit corresponding to the voltage/time diagram according to the block circuit image in FIG. 2 and the voltage/time diagram in FIG. 3, with fall delay below 1 $\mu$A and fluctuation or range of the thyristor threshold voltage of ±150 mV in 50 mV steps at the control input of the ignition circuit, FIG. 5. A block circuit diagram of a first example of the invention, FIG. 6. A current/voltage diagram analogous to FIG. 4 with fall delay below 1 $\mu$A and fluctuation or range of the thyristor threshold voltage of ±150 mV in 50 mV steps at the control input of the ignition circuit for the example according to FIG. 5, FIG. 7. A current/voltage diagram for the control current of the thyristor ignition circuit analogous to FIG. 4, with fall delay below 1 $\mu$A and fluctuation of the Zener breakdown voltages of the series Zener diodes at ±1V, FIG. 8. A block circuit diagram of a second example of the invention, FIG. 9. A current/time diagram analogous to FIG. 7 with fall delay below 1 $\mu$A and fluctuation of the Zener breakdown voltages of the series Zener diodes at ±1V for the example in FIG. 8, FIG. 10. A comparison of the control currents transferred over time from the relevant thyristor ignition circuits in the arrangement according to the state of the technology in FIG. 2 and for the example of the invention in FIG. 8, FIG. 11. A block circuit diagram of another example of the invention.

(h) DETAILED DESCRIPTION OF THE INVENTION

The arrangement of the ignition in the invention is based on a magnetic generator which includes a motor fixed on a crankshaft (not represented) with a rotor P with a peripherally arranged magnet M. The turnability or turn direction is indicated with an arrow. At the north and south poles of the magnet M is a pole shoe N, S. This magnet arrangement M, N, S is moved with each revolution of the rotor P on an iron yoke core K with two limbs. With each revolution, the magnetic field can close with the flow F if the two limbs on the iron yoke core K are partly opposite one of the two pole shoes N, S. The limb opposite the south pole in the closed magnetic field is surrounded by the ignition transfer U5 and by the trigger coil U2 while the limb opposite to other pole, north, is surrounded by a charge coil U1. When the rotor P turns in the charge coil U1 and in the trigger coil U2, an electrical current is induced.

Figure 2:
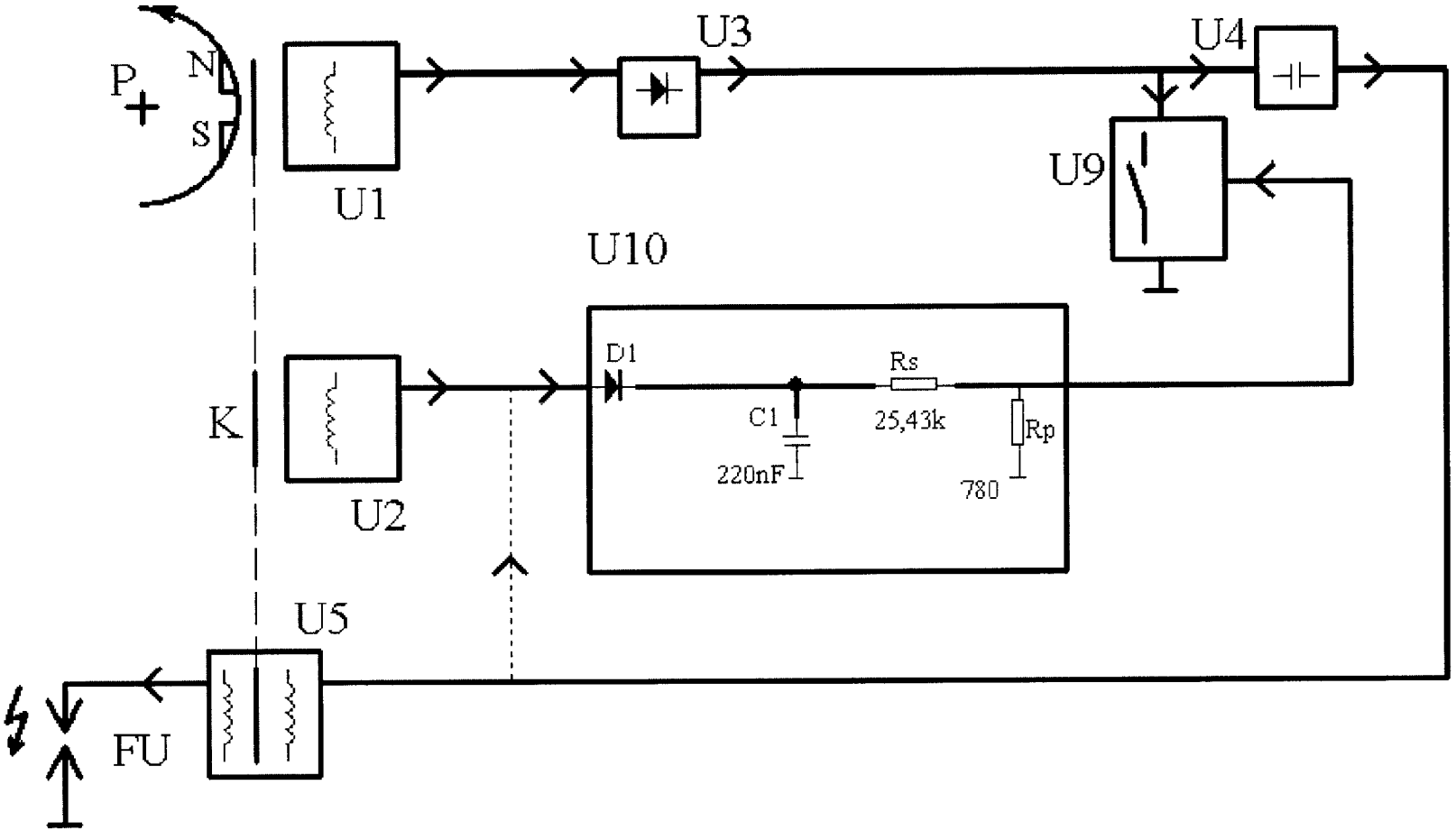

In FIG. 2, the current induced in the charge coil U1 is used to charge the ignition capacitor U4 via a rectifier U3, which is connected to an ignition transfer U5 in order to generate an ignition spark in the ignition spark gap FU. The second current induced in the trigger coil U2 is used, after rectification through a diode D1 to charge the trigger capacitor C1, which in the example has a capacity of 220 nF. This is switched off against earth by the cathode of the named rectifier diode D1. Parallel to the capacitor C1 is a potentiometer-type resistor Rs connected to the diode D1 against earth, Rp with the values for two resistances can be seen in the diagram. A partial current between the first potentiometer-type resistor Rs and the second potentiometer-type resistor Rp is conducted to an ignition circuit U9 which serves to discharge the charged ignition capacitor U4. The ignition circuit U9, ideally realised with thyristor, can be controlled or discharged if sufficient control energy is available on the potentiometer-type resistor Rs, Rp.

Figure 3:
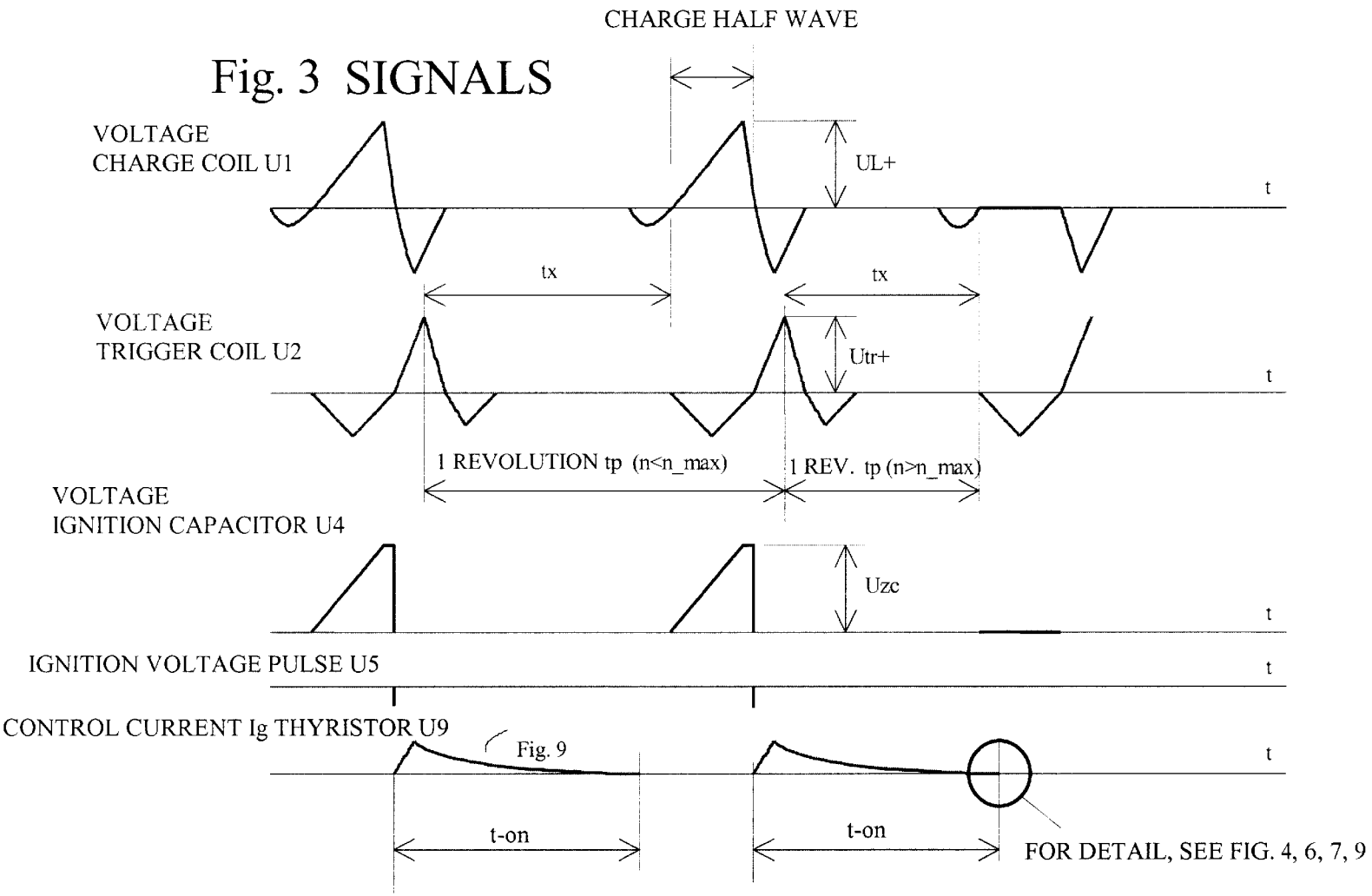

In FIG. 3, the currents induced in the charge coil U1 and the trigger coil U2 each comprise a negative, a positive and a subsequent negative half wave. As a result of the spatial arrangement of the charge coil U1 on the first yoke limb in the direction of rotation and the trigger coil U2 on the second yoke limb in the direction of rotation, the current from charge coil U1 passes ahead of the current from the trigger coil U2. The subsequent positive current impulses from the trigger coil U2 (or also from the primary coil of the ignition transfer U5, as indicated) activates the ignition circuit U9 via the revolution limiter module U10, which includes the so-called diode D1, the trigger capacitor C1 and the potentiometer-type resistor Rs, Rp, with the ignition capacitor U4 being discharged quickly in interaction with the primary coil of the ignition transfer U5. This generates a typically negative ignition current impulse which emits an ignition spark into the ignition spark gap FU of the ignition of the combustion engine.

The positive current impulses reach the revolution limiter circuit U10 from the trigger coil U2 via a rectifier Rs and Rp to the control connection of the ignition circuit U9. Parallel to this, the trigger capacitor C1 is charged. This discharges via the rectifier Rs, Rp and in this way the ignition circuit U9 is controlled with a control current falling according to an exponential function after the end of a positive voltage impulse from the trigger coil U2 for the time t-on. For revolutions below the maximum admissible (n<n_max) the start of the next positive charge coil current appears after the end of the previous switch on period t-on. The ignition circuit is thus no longer controlled at this time. For revolutions above the maximum admissible (n_max) the start of the next positive current half wave by the charge coil current U1 appears before the end of the previous switch on period t-on because of the time constants or delay of the revolution limiter circuit U10 set by the trigger capacitor. A revolution of the rotor P is completed quickly, with a period tx between the vertex of the relevant positive trigger current half wave and the start of the positive half wave of the relevant subsequent half wave of the current to the charge coil U1 is reduced. The ignition circuit U9, therefore, is at this time (start of the half wave of the current of the charge coil U1) still controlled doe revolution n>n_max. The charge current from the charge coil U1 can not flow into the ignition capacitor U4 but is short-circuited or discharged via the circuit path of the ignition circuit U9. Ideally, a thyristor is used as ignition circuit U9 which has the feature that it remains switched on as long as a charge current from the charge coil U1 flows to earth via the short circuit in ignition circuit U9, even if no control current is flowing from the revolution limiter module U10. With an active revolution limit, the entire positive half wave from the charge coil U1 remains short circuited via the ignition circuit U9, the ignition capacitor U4 is not charged and thus no ignition impulse is generated. The decisive factor for the maximum admissible revolutions is the end of the connecting time t-on relative to the start of a positive half wave from the charge coil U1. The connecting period t-on is determined by the parts of the revolution limiter circuit, namely the trigger capacitor C1 and the potentiometer-type resistor Rp, Rs and by the sensitivity of the control input of the ignition circuit U9 and the amplitude of the voltage induced in the trigger coil U2, which determines the charge voltage of the trigger capacitor C1. The control voltage, which has to connect with the control input or the gate on the ignition thyristor so that a gate control or trigger current can flow, must exceed a certain threshold. The higher this threshold voltage, the easier or earlier the control current undercuts the trigger or switch through wave and the switching period t-on becomes shorter.

Because of other details if this ignition control principle already known, the aforementioned patent publication EP 0 584 618 A2 and DE 196 45 466 A1 are referred to.

Figure 4:
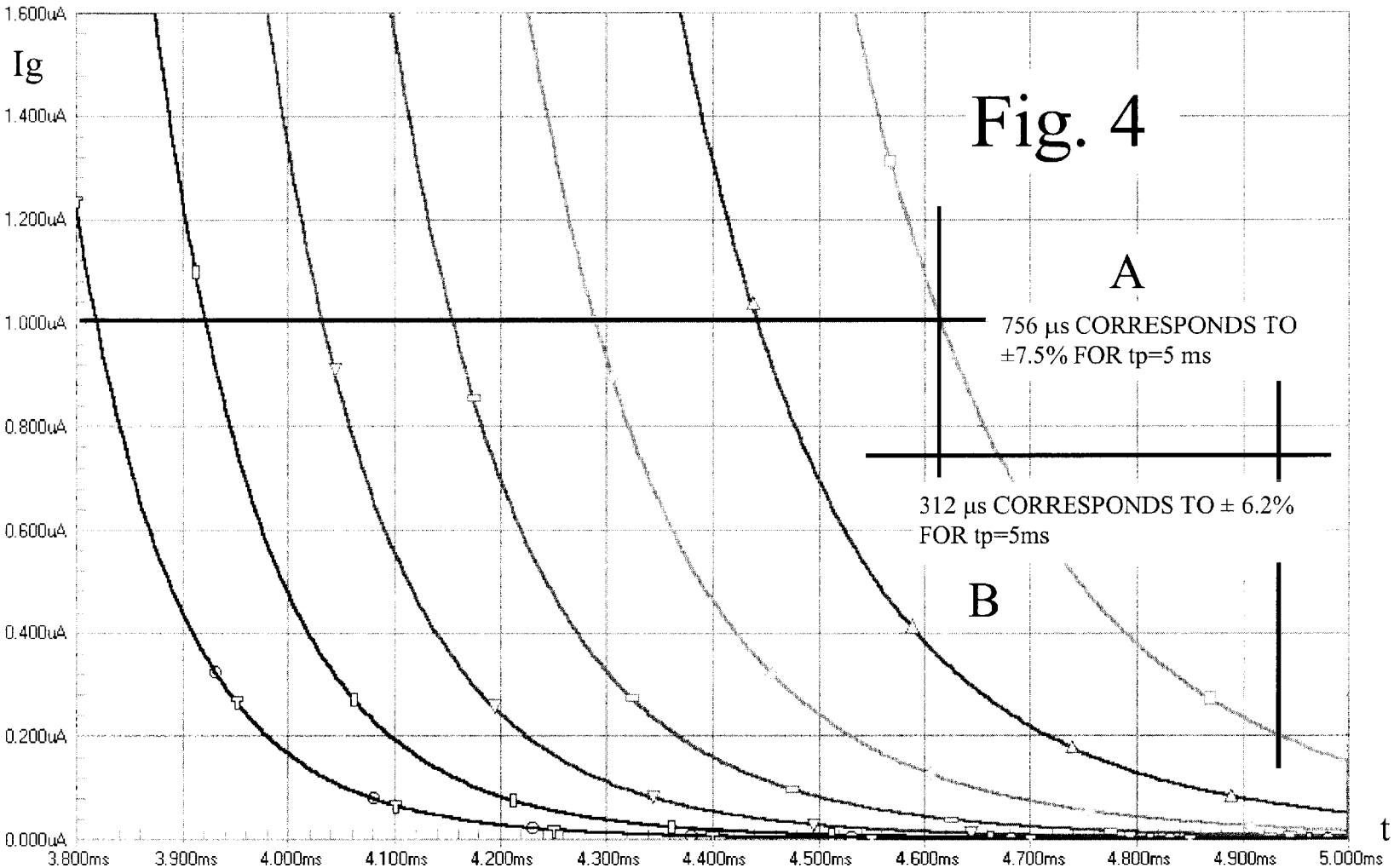

In FIG. 4, the temporal inaccuracies and fluctuations can be seen which result from the ignition arrangement with revolution limit according to the latest technology (FIGS. 1–3). It is an enlargement of the progress of the control current lg by the time t at the control input of the thyristor ignition circuit U9 during the end of the connecting period t-on (cf. area circled in FIG. 3), when the voltage wave for the switch through of the thyristor used fluctuates in 50 mV steps by ±150 mV. With a sensitivity of 1 $\mu$A gate control current of the thyristor, a fluctuation A of the connecting time t-on until the 1 $\mu$A limit is undercut of 765 $\mu$s. This corresponds to 15% or ±7.5% for a period tp of 5 ms and an upper limit for the maximum admissible revolutions per minute of 12000. The reason for the fluctuation is that a limited change in the threshold voltage of the ignition circuit thyristor U9 causes a relatively strong change in the power distribution between the resistance Rp of the potentiometer-type resistor and the control input of the thyristor ignition circuit U9. In order to improve this, it is necessary to select the directly earthed resistance Rp with high levels of resistance and the other potentiometer-type resistor Rs at low levels of resistance for potentiometer-type resistor Rs, Rp. In addition, the highest possible control energy can produce an improvement which is missing, however, for the ignition spark generation.

Rs, Rp. In addition, the highest possible control energy can produce an improvement which is missing, however, for the ignition spark generation.

Further more, the connecting current lg of the thyristor ignition circuit fluctuates, for example, between 1 $\mu$A and 200 nA. This produces an additional fluctuation B of 312 $\mu$s, which corresponds to 6.2% for a period of tp=5 ms. The reasons for this is that the relevant range for the tolerance of the revolution limit is located in the end range of the discharge curve of the trigger capacitor C1. The discharge curve at this point is very flat, corresponding to its character as an exponential curve. Indeed, a higher control energy for lower resistance at the same time earthed directly with Rp resistance would result in a steeper or faster transfer from 1 $\mu$A to 200 nA. Since a change to the resistance in the potentiometer-type resistor Rp, Rs partly positively and partly negatively influences the tolerances from the temporal fluctuations A, B, the result is that no improvement can be achieved. As discussed above, an increase in the control energy is not a beneficial solution due to the associated disadvantages for the entire ignition system.

Figure 5:
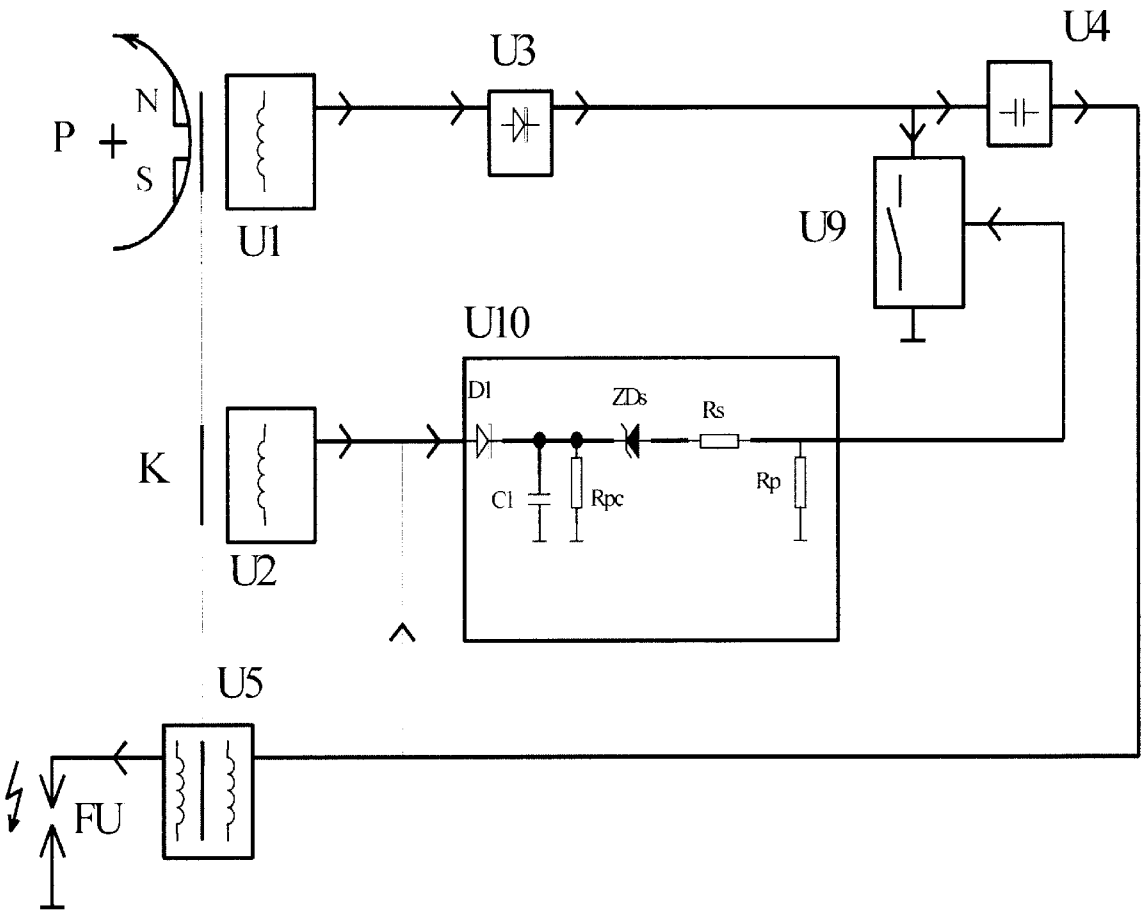

By contrast, according to the invention, the solution or assistance proposed, to connect the area of the gate control current for the thyristor ignition circuit, which is decisive for the revolution limit accuracy, between 1 $\mu$A to 200 nA in a steeper range of the exponential discharge curve. The example of the invention shown in FIG. 5 shows a series Zener diode ZDs, e.g. with a Zener breakdown voltage of 24V connected between the trigger capacitor C1 and the potentiometer-type resistor Rs, Rp with the control path for the thyristor ignition circuit U9 such that the current on the trigger capacitor C1, minus the Zener breakdown voltage, reaches the potentiometer-type resistor Rs, Rp. As a result, the thyristor ignition circuit U9 is controlled by a steeper or faster falling control current in the relevant or critical range between 200 nA and 1 $\mu$A, which reduces the tolerances of the revolution limiter and increases its accuracy. In conjunction with this, an increase of the directly earthed potentiometer-type resistor resistance Rp is useful, e.g. at 22 kOhms, in order to get by with a smaller control current. As already known, a Zener diode is switched in blocking direction or "tensed" and only allows current through above a certain threshold voltage in the manner of a short circuit.

The earthed parallel resistor rpc, connected in parallel to the trigger capacitor C1 in FIG. 5 serves to discharge the charge capacitor C1 under the Zener breakdown voltage of the series Zener diode ZDs. This is particularly beneficial and useful so that if the Zener breakdown voltage is undercut, the discharge line is not too flat, especially in the relevant or critical end of t-on. The parallel resistance Rpc facilitates a discharge of the trigger capacitor C1 under the Zener breakdown voltage.

A comparison of the state of the technology according to FIGS. 1–4 with the example of the invention in FIG. 5 gives the following differences. A resistor Rpc is switched to earth parallel to the trigger capacitor C1. This forms a discharge resistance for the trigger capacitor C1. Further, the named series Zener diode is connected between the trigger capacitor C1 and the current path to the control input of the thyristor ignition circuit U9 before the series resistor Rs of the potentiometer-type resistor Rs, Rp. For a half wave positively induced by the magnetic generator, the trigger capacitor C1 is charged and discharges according to an exponential function, as with the current state of technology. In the invention, the flat part of this exponential function is removed with the series Zener diode ZDs. However, the thyristors available for the realisation of the ignition circuit U9 produce a fluctuation range for the gate control current between 1 $\mu$A and 200 nA, at which they are switched through into the leading state. In order to increase the dynamics and the accuracy of the revolution limiter, the range between 1 $\mu$A and 200 nA should be passed through as quickly as possible so that the fluctuations of the ignition circuit control time and the revolution upper limit can be kept to a minimum. The earthed parallel resistor Rpc serves to discharge the charge capacitor within the revolution limiter circuit U10. The series Zener diode ZDs in the invention has the function of only allowing the steep range of the exponential discharge curve of the trigger capacitor C1 in conjunction with the control input of the thyristor ignition circuit U9 or to switch through to the thyristor based on the Zener breakdown voltage. This results in the transfer between 1 $\mu$A and 200 nA as the control range for the thyristor ignition circuit being steeper and being passed through more quickly. As a result, the fluctuations of the control time t-on for the thyristor ignition circuit U9 and the time fluctuations of the revolution limiter circuit U10 are less.

Figure 6:
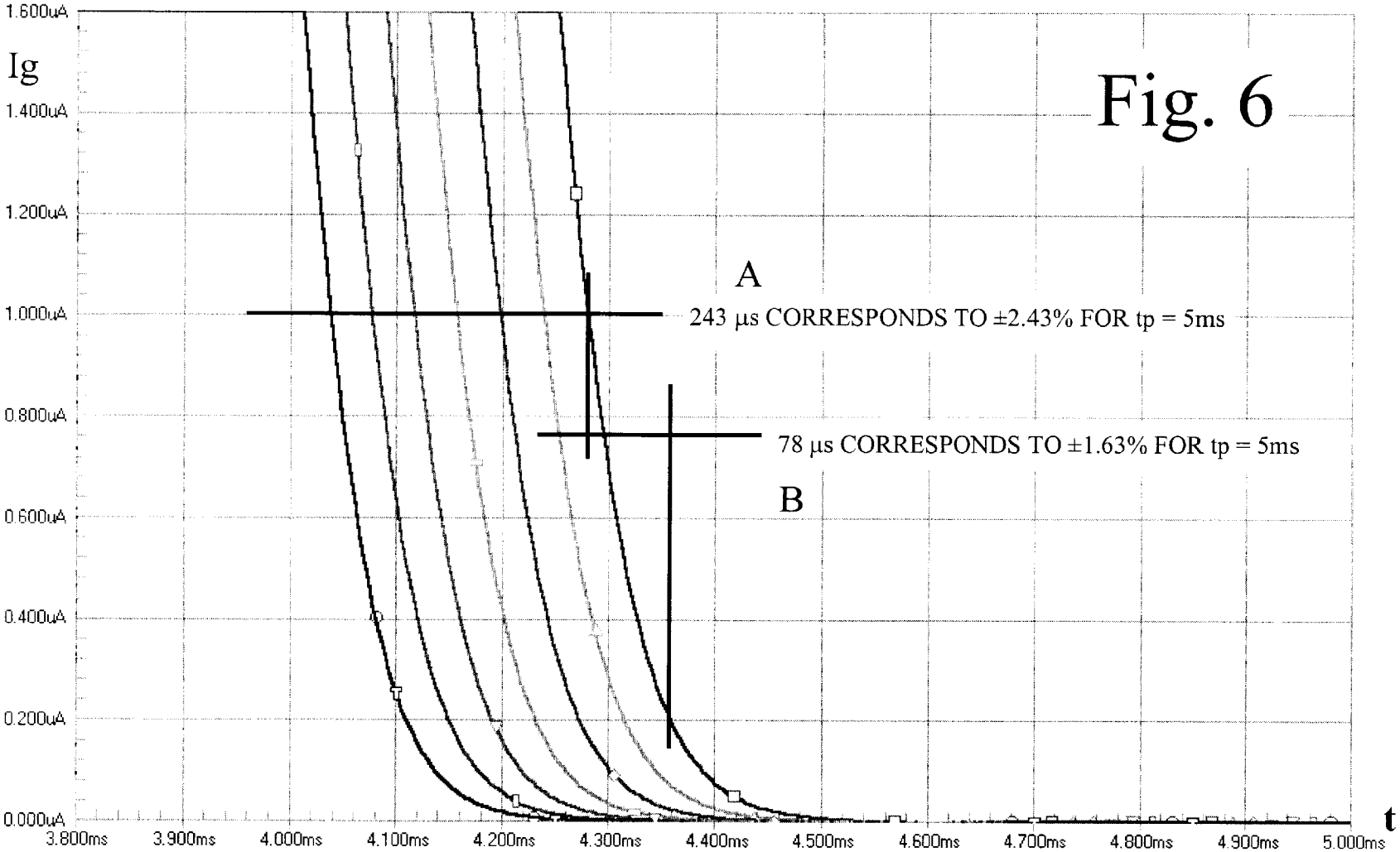

A comparison of FIG. 4 with FIG. 6 shows that the temporal range or the fluctuation of change band of the control current delay with the invented circuit id substantially less or more narrow that the current state of technology. This comes from the relevant time fluctuation B in FIGS. 4 and 6. Further, it can be seen that voltage fluctuations at the (gate) control input have a greater effect by 150 millivolts at the current state of the technology than in the invention. The effect of this reduction in the time inaccuracies is achieved by the series circuit with the series Zener diode ZDs which only allows through the steep voltage section because of the Zener effect. The improvements as a result of the invention can be seen in the line in FIG. 6. A tabular comparison of the influence of the fluctuation of trigger or gate control current lg and of the threshold for switch through current on the achievable revolution upper limit in % (based on the period tp=5 ms) makes this clearer.

| | Current state of technology | Invention |
|---|---|---|
| Diagram: | FIG. 4 | FIG. 6 |
| Circuit: | FIG. 2 | FIG. 5 |
| Time fluctuation A for fluctuation of the threshold for the control current by ±150 mV: | +/− 7.5% | +/− 2.43% |
| Time fluctuation B for fluctuation of the gate control current 1 g between 1 $\mu$A and 200 nA: | 6.2% | 1.6% |
| Total fluctuations: | 21% | 6.4% |

Figure 7:
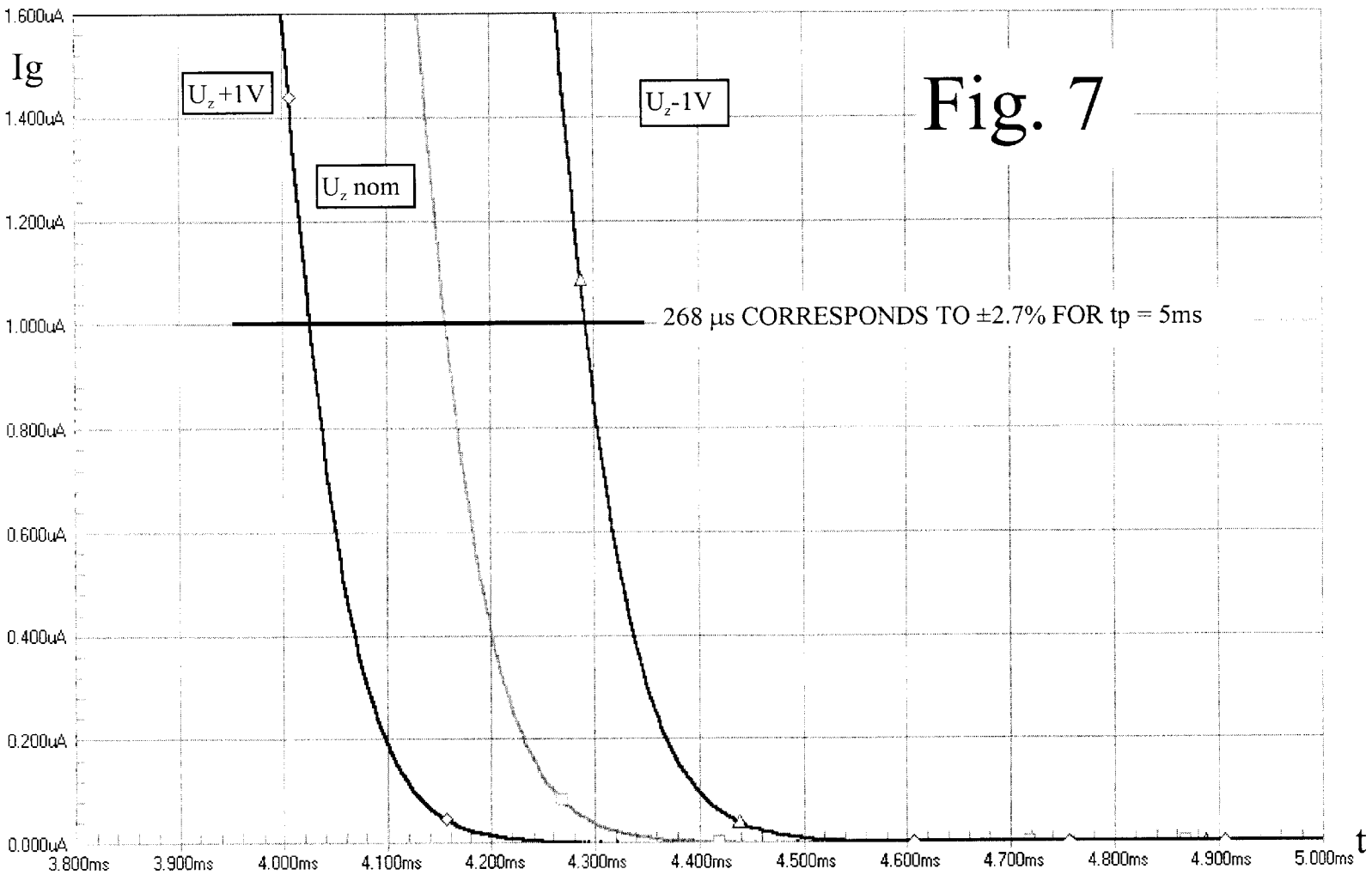

As a result of the additional component ZDs, however, there are still fluctuations in the Zener voltage of +/1 1V with a nominal 24V for this component. This influence is shown in FIG. 7. At a trigger current of 1 $\mu$A, this gives time fluctuations of +/−2.7%. This reduces part of the benefit of Zener diodes without narrowed tolerances are used. The cause for this effect is that, for a higher Zener voltage, a higher proportion of the voltage is subtracted from the voltage of the charger capacitor, and thus the control path of the thyristor is controlled for a shorter period.

Figure 8:
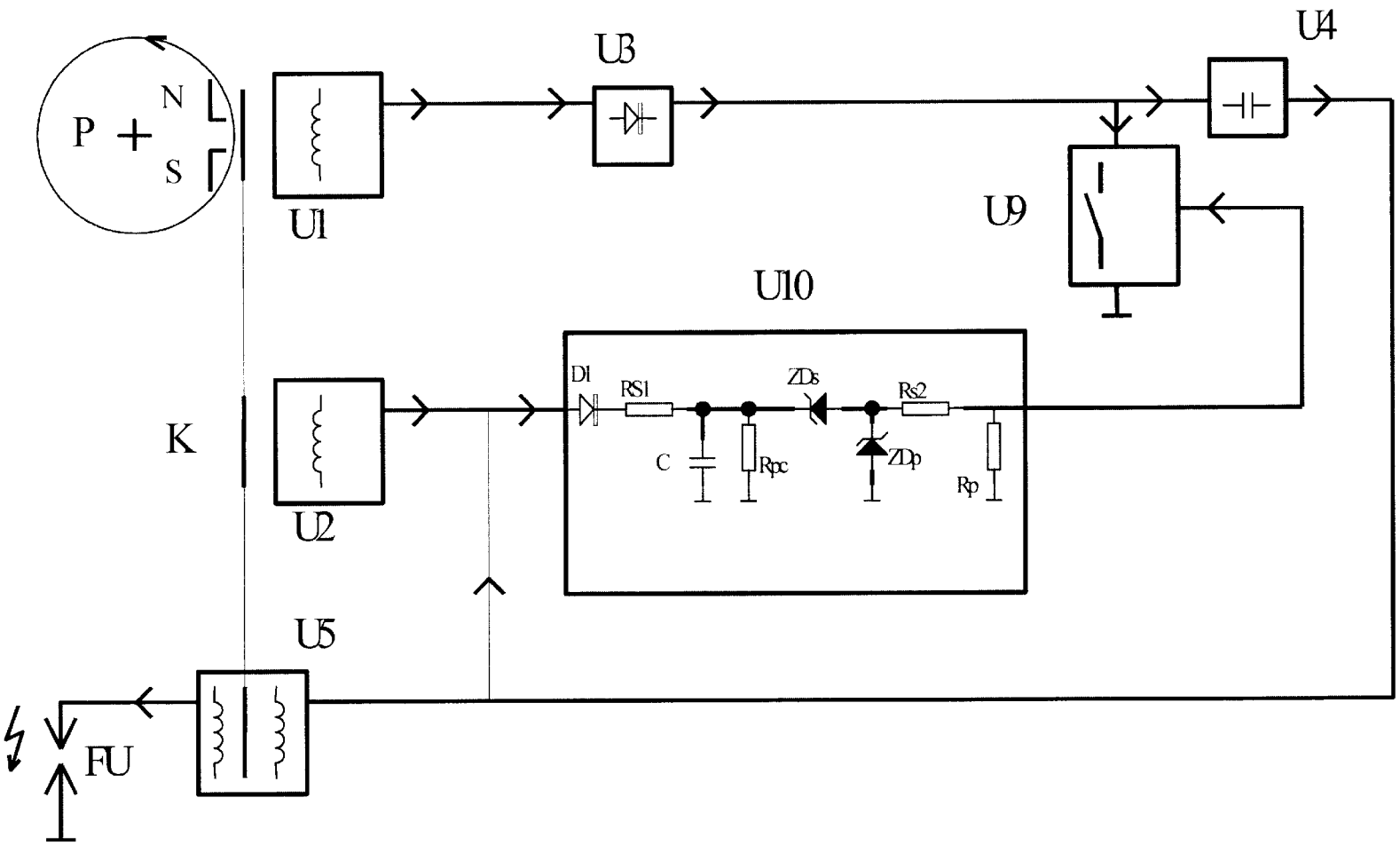

In order to approach the problem of fluctuation of the first series Zener diode, another (parallel) Zener diode ZDp compensates for the time fluctuation due to eh fluctuations of the series Zener diode ZDS as shown in another diagram of the invention corresponding to FIG. 8. Series and parallel Zener diodes ZDs, ZDp of the same type and, where possible, with the same manufactured charge must be used. This is achieved when using Zener diodes from subsequent positions in a lot. The parallel Zener diode ZDp is connected to the series Zener diode ZDs such that both are in series and in parallel to each other and to the trigger capacitor C1, where the parallel Zener diode is placed to earth after the first series Zener diode ZDs. In this way, the maximum chare voltage of the trigger capacitor C1 is determined by the sum of the Zener voltages of ZDs and ZDp. Thus, a higher voltage at the charge capacitor is achieved. The parallel Zener diode ZDp in FIG. 8 determines the voltage at the trigger capacitor C1 if the series Zener diode ZDs is switched through.

Figure 9:
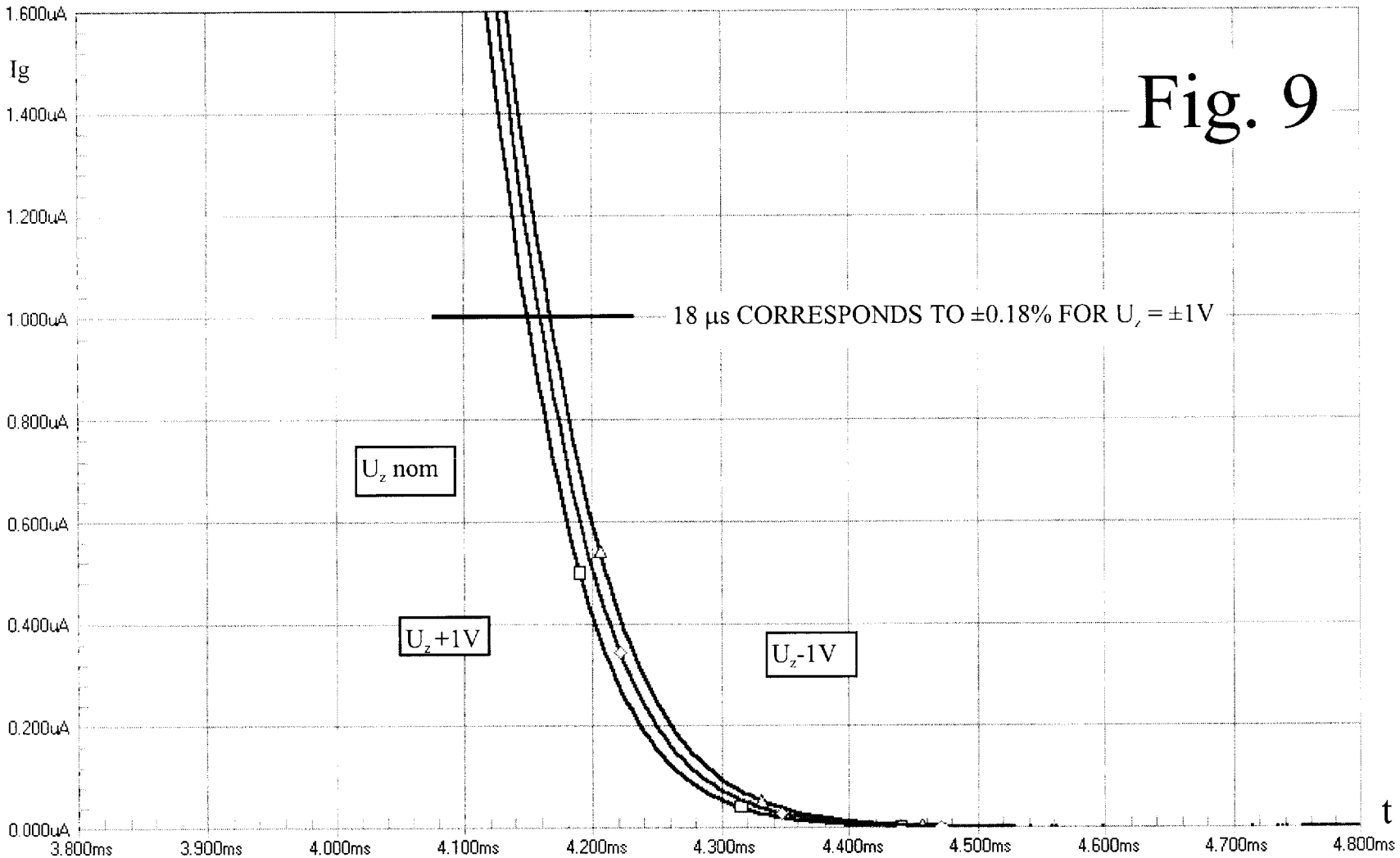

In FIG. 9, the influence of the fluctuation of the two Zener breakdown voltages ZDs, ZDp is reflected each by +/−1 V of the realised upper revolution figure with only +/−0.18%, so that the fluctuations of the Zener voltage when using 2 Zener diodes as in FIG. 8 can be ignored. The compensation is based on the fact that the value of the Zener voltage of the series Zener diode ZDs not only determines the control time of the thyristor ignition circuit U9 while discharging as described above, but also the voltage at which the trigger capacitor is charged due to the interconnection of the two Zener diodes ZDs and ZDp. A higher Zener voltage would produce a shorter control time for the thyristor. As, however, this also achieves a high charge voltage at the trigger capacitor C1, which causes an extension of the control time, the control time reduction and extension offset each other. The Zener diodes ZDs, ZDp, together with the resistor RS1, which is switched in series to the rectifier diode D1 and which leads to the trigger capacitor C1, and the trigger coil U2 are of a size that when the upper revolution limit is reached, both Zener diodes lead to the trigger capacitor C1 when the charging has ended. This also has the advantage that the fluctuations of the strength of the magnet M, or fluctuations of a gap L between an iron core limb and the extent of the rotor, ad thus of the magnetic flow F and thus also of the trigger voltage, only slightly influence the charge voltage of the trigger capacitor C1. In this way, the effects on the admissible upper revolution limit can be ignored. Using the current limit resistor RS1 the current from the trigger coil U2 is limited and thus the energy uptake of the revolution limiter circuit U10 is reduced.

Figure 10:
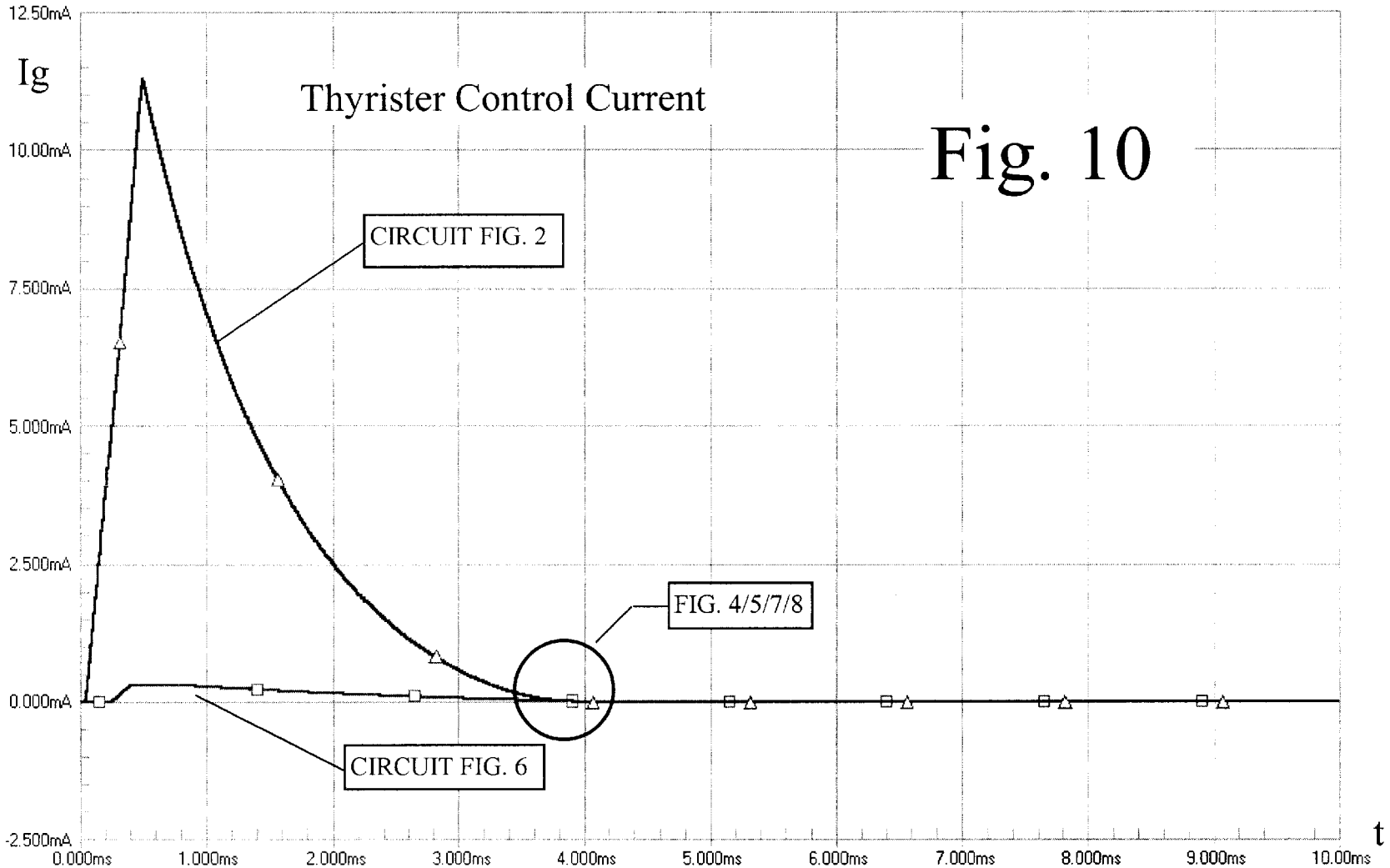

In FIG. 10, the voltage saving or energy saving can be seen, which can be achieved with the invention for the revolution limiter circuit. The entire process of the relevant control current lg for the thyristor ignition circuit U9 is shown across time. The current lg is substantially less for the circuit in the invention, FIG. 8, but as can be seen in the detailed FIGS. 6, 7, 9, the delay of the control current lg in the relevant section, between 1 $\mu$A and 200 nA, is substantially steeper. A higher control current above 10 mA, as in FIG. 10, is necessary for the revolution limiter circuit in FIG. 2 according to the current state of technology. However, the control current lg required according to the circuit in FIG. 8 is of smaller magnitudes. In the invention, only the steep range of the discharge curve at the charge capacitor is used in the revolution limiter circuit U10. The less steep range is suppressed by the Zener diodes ZDs, ZDp. These enforce their constant Zener voltage which, in the ideal case, agree exactly when using two Zener diodes of the same type and charge (same manufactured charge). FIG. 10 shows that despite the lower energy requirement, the dynamics of the revolution limiter circuit within the fluctuation range is considerably higher for the thyristor discharge or ignition circuit U9. The fluctuation range of the thyristor is steeper because of the invention's revolution limiter circuit U10. For only the step range of the trigger capacitor discharge curve is used with the Zener diodes. Thus there is also a new process with the invention. When setting up the circuit according to the invention, less energy is required for control and thus less energy is taken from the flux F for the revolution limiter circuit U10. Compared to the current state of technology, the invention allows the trigger capacitor to be smaller. Further more, with the invention a lower charge voltage can be sufficient from the trigger coil U2.

Figure 11:
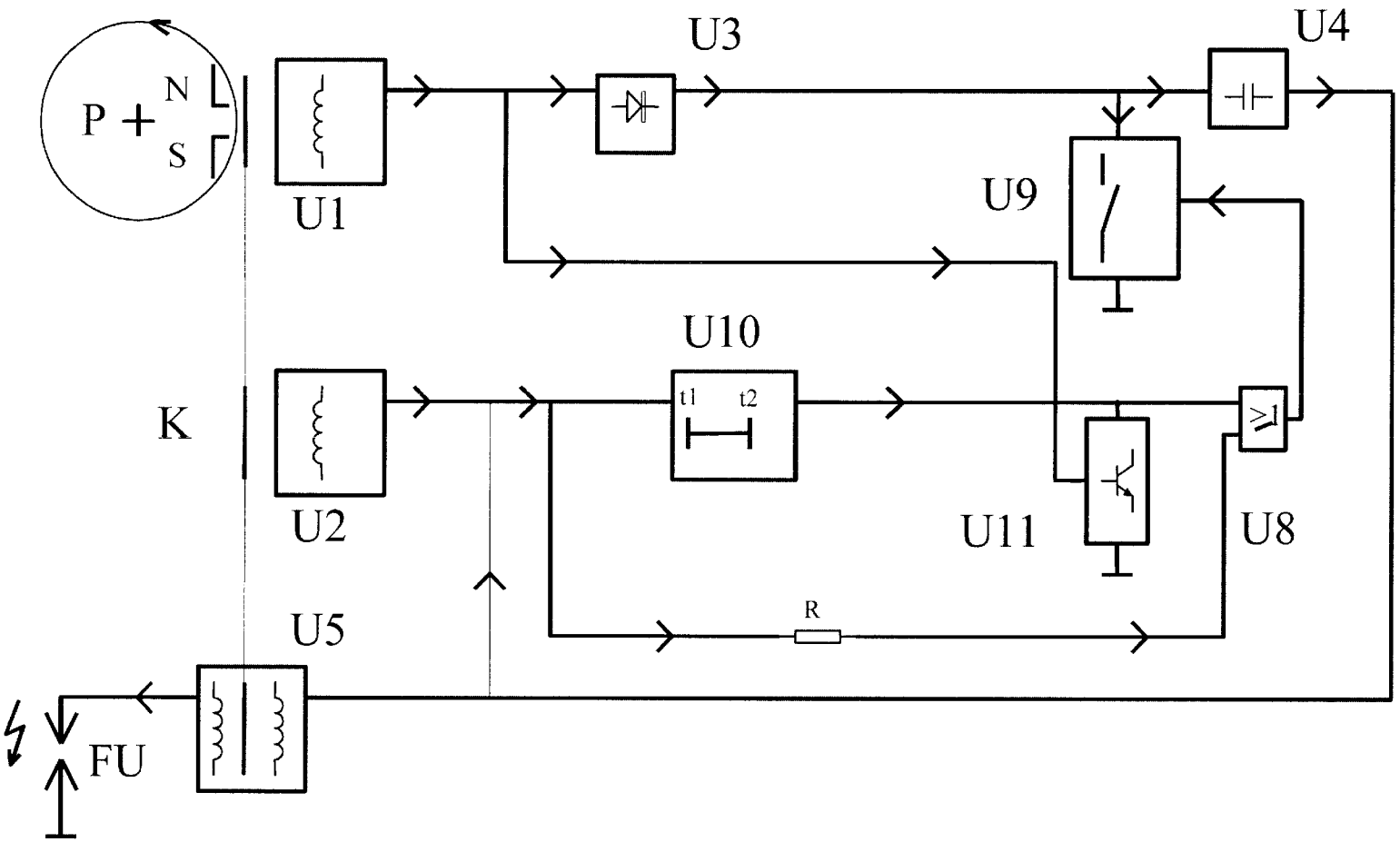

With the invention examples described above, the series Zener diode ZDs in the ignition circuit U9 can only be controlled when the motor revolution is so high that the trigger coil voltage U2 reaches the value of the Zener breakdown voltage. In certain systems, this can lead to the motor being more difficult to start. As assistance for this, FIG. 11 shows a resistance R arranged in a parallel path to the revolution limiter circuit U10. As a result of this parallel path with resistance R, the positive trigger coil voltage is conducted via an analogue OR gate U8 to the discharge circuit U9, whose activation is repeated almost without delay.

As is known, as the voltage at the switch through path of the thyristor ignition circuit U9 and its increasing steepness increases, the necessary gate control current lg reduces, which leads to the ignition of the thyristor. At revolutions slightly below the upper revolution limit, the voltage steeply increase at the ignition capacitor U4 and at the same time this is connects to the switch through path of the thyristor ignition circuit U9. Simultaneously, the control current lg only just undercuts the trigger or ignition threshold for the thyristor ignition circuit U9. Since the above voltage increase results in moving the trigger current to smaller values, unintended switch through of the thyristor can occur more easily during the charge phase. This leads to a high voltage impulse of lesser amplitude at an earlier time, e.g. at a revolution of 60° before the upper dead point. This can lead to a flashover at the ignition coil FU. Further more, in this case there is no high voltage impulse at the actual time of ignition. Thus, just under the upper revolution limit, slight ignition failures can occur. When expanding the circuit, a strong fluctuation of this process was found. Depending on the individual thyristor and thyristor type, this was found in a revolution range of 0 to 300 revolutions per minute below the upper revolution limit.

To remedy this, in further developments of the circuit, in FIG. 11, a block circuit U11 was added in order to reduce the effects of the repercussions of the voltage in the switch through path of the thyristor ignition circuit to its sensitivity. The circuit U11 in the invention is connected above a positive voltage to the charge coil U1 of a few volts, e.g. 10 V, so that the gate control current from the revolution limiter circuit to the thyristor is short circuited before the thyristor ignition circuit U9. The function of the threshold decision is also implemented in the realised block circuit, for example, as a switching transistor. However, the voltage threshold has been selected such that a switch through of the thyristor ignition circuit U9 during the charge voltage increase to the charge coil U1 (cf. FIG. 3—"Current charge coil U1" and "Current ignition capacitor U4") does not occur. The block circuit is switched only during the positive half wave of the charge coil U1 or at the ignition charger U4, and then for its threshold function or control threshold shortly after the start of the charge half wave. If, at the start of the charge half wave, the current strength at the control input of the ignition circuit U9 (in the example, gate of the ignition thyristor) is not sufficient for a switch through, a switch through can no longer occur for the subsequent period of the charge half wave, for example because of the increased sensitivity of the ignition circuit control, because the block circuit prevents control of the ignition circuit U9 for this period. The end of the period tx, in which the ignition circuit U9 can be controlled from the trigger element, for example capacitor C1, is thus sharply focussed. In this way, the revolution range with individual failures below the revolution limit does not occur, the result of which allows a more precise revolution limit.

REFERENCE LIST

P Rotor
M Magnet
N, S Pole shoe
K Iron yoke core
F Magnetic flow
U5 Ignition transfer
U2 Trigger coil
U1 Charge coil
U3 Rectifier
U4 Ignition capacitor
FU Ignition spark gap/ignition spark
D1 Diode
C1 Trigger capacitor
Rs, Rp Potentiometer-type resistor
Rs, Potentiometer-type resistor resistance
Rs2 Potentiometer-type resistor resistance
Rp Potentiometer-type resistor resistance
U9 Ignition circuit
U10 Revolution limiter circuit
t-on Switch on time
n_max Revolution limit
tx Duration
lg Control current
t Time
A Time fluctuation
B Time fluctuation
tp Duration of period
ZDs Series Zener diode
Rpc Parallel resistance
ZDp (Parallel) Zener diode
RS1 Current limit resistance
R Resistance
U8 OR gate
U11 Block circuit/switching transistor
Uzc Voltage at which the ignition capacitor is charged
UL+ Positive charge voltage from the charge coil U1 to charge the ignition capacitor
Utr+ Positive trigger voltage from the trigger coil U2 to charge the trigger capacitor in the RC timer
tx Time between start of discharge of the RC timer and the start of the positive charge half wave.

What is claimed is:

1. A revolution threshold regulator and/or toggle switch with a first and a second fixed phase source of alternating current which are generated dependent on and, in their frequency, proportionally to the revolution speed of a rotor, and with a trigger device which scans the alternating currents to emit a control signal at a revolution threshold above or below a preset revolution threshold, where the trigger device has a timer module, and this timer module works with one of the alternating current sources from a chargeable trigger charge element which can be discharged via at least one discharge path to create a control signal, where the trigger charge element, as it discharges, sends a control current through a series Zener diode in a blocking direction to the output for the control signal.

2. An apparatus for starting a motor, in particular, in hand-held machines, with a revolution threshold regulator and/or toggle switch, the apparatus including a magnetic generator which induces alternating current dependent on the revolutions and thus charges an ignition charger element for ignition spark energy, and the apparatus also including a trigger device which scans the alternating current in order to activate a discharged ignition circuit in the ignition element in conjunction with the primary coil of an ignition transfer in the ignition charger element, with the trigger device being a module for limiting the revolution speed of the motor and this revolution limiter works with a trigger charger element which can be recharged from a source of alternating current in the magnetic generator, which can be discharged by at least one path for controlling and activating the ignition circuit, where the trigger charger element, as it discharges, sends a control current to an ignition circuit via a series Zener diode in blocking direction.

3. An apparatus according to claim 2, having first and second discharge paths which are switched in parallel to the trigger charger element, where one of the two discharge paths at least has the series Zener diode and the other discharge path as at least one resistor.

4. An apparats according to claim 2 or 3, wherein the second discharge path has a potentiometer-type resistor with several resistors and the series Zener diode which forms a current path from the trigger charger element to a control input on the ignition circuit is in series with at least one of the resistors of the second discharge path.

5. An apparatus according to claim 2 or claim 3 wherein a second, similar parallel Zener diode is connected in the block direction opposite the trigger charger element such that a charge or output current of the trigger charger element is limited to the total of the Zener breakdown voltages at the two Zener diodes.

6. An apparatus according to claim 5, wherein the series Zener diode and the parallel Zener diode are connected to each other in parallel in series to ground and/or together to the trigger charger element or to the discharge path.

7. An apparatus in accordance with claim 6 wherein a current limiter resistor is connected between the trigger charger element and the scanned alternating current source.

8. An apparatus in accordance with claim 7 wherein the current limiter resistor is of such a size that upon reaching a preset revolution limit for the motor, the Zener breakdown voltage stops in the series and parallel Zener diode at the end of the charge cycle for the trigger charger element.

9. An apparatus in accordance with claim 8, wherein the current limiter resistor has a resistance of more than 500 Ohms.

10. An apparatus in accordance with claim 2, wherein that the trigger device has a parallel current path bridging the revolution limiter module from the source of the alternating current to a control input at the ignition circuit.

11. An apparatus in accordance with claim 10 wherein a forward bar is directly connected with the control input analog OR gate which is connected to the outputs of the revolution limiter module and the parallel current path.

12. An apparatus in accordance with claim 11, wherein the parallel current path is configured with a high level of resistance.

13. An apparatus in accordance with claim 2, wherein a block circuit is connected to the outputs of the revolution limiter module which block the output signal from the revolution limiter module which is controlled from a source of alternating current from the magnetic generator which serves to charge the ignition charger element.

14. An apparatus in accordance with claim 13, wherein the block circuit is a threshold value switch circuit with a control threshold which is stopped when a preset voltage level is reached and/or when a preset increase period for a charge half wave from the source of alternating current has elapsed.

15. An apparatus in accordance with claim 14 wherein the preset voltage level and/or period of increase is measured such that activation of the ignition circuit is facilitated by the revolution limiter module before the block circuit is activated by the charge half wave of the source of alternating current.

16. An apparatus in accordance with claim 14 or claim 15 wherein the preset voltage level and/or the preset increase period is measured such that any prior discharge of the ignition charger element does not occur until the block circuit has sufficient energy to form an ignition spark.

17. An apparatus in accordance with claim 13 or claim 14 or claim 15 wherein the block circuit is arranged such that the output of the revolution limiter is short-circuited to earth.

18. An apparatus for starting a motor, especially in hand-held tools, with a magnetic generator which induces alternating current based on the revolution speed and thus charges an ignition charger element for ignition energy, and with a trigger which scans the alternating current to activate an ignition circuit that is discharged via the primary coil of an ignition transfer, where a revolution-related function is activated by a revolution circuit, which is designed such that the revolution circuit which works by comparing 2 fixed events with the time of an electronic circuit controlled by the RC timer, where the timer is started by a first fixed event which is a voltage pulse and the switch state of the revolution circuit when the second event which is a voltage pulse occurs is determined by the time of the second event relative to the controlling end of the timer, where the start of the control with the first fixed event and the end of the control with the charge amplitude being undercut by approximately 50% from C of the RC timer.

* * * * *